US005282436A

United States Patent [19]

Hansen

[11] Patent Number: 5,282,436

[45] Date of Patent: Feb. 1, 1994

[54] FOAM STABILIZED WATERCRAFT

[76] Inventor: William M. Hansen, 8201 Orchard Ave. SE., Port Orchard, Wash. 98366

[21] Appl. No.: 821,979

[22] Filed: Jan. 15, 1992

[51] Int. Cl.[5] ..... B63B 1/20

[52] U.S. Cl. ..... 114/283; 114/357

[58] Field of Search ..... 114/360, 68, 123, 345, 114/283, 284, 292, 285, 356, 219, 322, 256, 263, 271

[56] References Cited

U.S. PATENT DOCUMENTS

| | | | |
|---|---|---|---|
| 4,520,746 | 6/1985 | Walters et al. | 114/123 |
| 4,625,674 | 12/1986 | Covington | 114/123 |
| 4,807,556 | 2/1989 | Hillier | 114/123 |
| 4,934,301 | 6/1990 | Harding | 114/345 |
| 4,964,821 | 10/1990 | Tafoya | 114/345 |
| 4,993,350 | 2/1991 | Pepper | 114/292 |

*Primary Examiner*—Edwin L. Swinehart

*Attorney, Agent, or Firm*—Christensen, O'Connor, Johnson & Kindness

[57] ABSTRACT

A high performance boat stabilized through the use of foam stabilizing members is provided. The boat has a rigid, planing hull including a transom, and a pair of curved sides extending forward from the transom to form a bow. A bottom is joined to the sides forming a chine. The foam stabilizing members are mounted on the sides of the hull above the chine and extend from the transom along the length of the boat. The sides of the boat also include an upper and lower flange extending outwardly from the sides of the boat adjacent to the upper and lower edges of the stabilizing members at the location where the stabilizing members attach to the sides of the hull. The lower flange helps to ensure that water is not forced in between the sides of the boat and the stabilizing members, thus preventing possible damage to the boat. Additionally, the stabilizing members are attached to the side of the hull without the use of holes extending from the exterior to the interior of the hull, thus preventing water from seeping into the hull.

20 Claims, 5 Drawing Sheets

FOAM STABILIZED WATERCRAFT

FIELD OF THE INVENTION

The present invention relates to boats that are stabilized with buoyant stabilizing members. Specifically, the present invention relates to boats that have rigid hulls and foam stabilizing members attached to the sides of the hulls and extending substantially around the perimeter of the hull.

BACKGROUND OF THE INVENTION

It is very important to design smaller boats with flotation devices in the hull to ensure that the boat remains floating in case substantial water gets into the boat or the boat capsizes. Additionally, foam flotation devices provide the boat with added buoyancy, thus increasing carrying capacity and safety. The installation of foam flotation devices is especially important in the case of small boats which are designed for operation on rough waters, such as in the case of rescue boats.

Many prior art boat designs incorporate foam devices within the hull of the boat, as in U.S. Pat. No. 4,060,865 (Woolworth). Typically, the foam flotation members are incorporated directly within the hull structure itself. These boat designs are generally safer than designs which do not incorporate flotation devices within the hull. Prior art designs use foam flotation devices within the hull to increase safety but do not take full advantage of the unique properties of the foam flotation devices in order to increase boat performance.

In U.S. Pat. No. 4,287,624 (Lowther), a series of foam flotation devices or wings are attached to the exterior and interior of a low-speed fishing boat. The exterior wings extend from the transom approximately to the point halfway between the transom and the bow where the wings terminate, thus presenting a large flat surface to the oncoming waves. The foam flotation wings provide increased stability and buoyancy to the boat hull, however, the teachings of Lowther would create significant problems if used on a high-performance, high-speed power boat. The flat surface presented to the water by the termination of the foam flotation wing would create a substantial hazard if the boat was operated at speeds over simple trolling speeds. At high speeds, the flat surface of the flotation wings could cause a loss of control of the boat or could cause the boat to "trip" on a wave, possibly capsizing the boat.

In the context of a boat, "tripping" means that an exterior surface of the boat contacts the water creating a force which causes the boat to deviate from its intended path. As an example, if the flat surface of the flotation wings in Lowther were to contact the water when the boat was moving at high speed, the force produced by the water striking the flat surface could cause the boat to begin spinning or even to list to the extent that the boat capsizes.

In addition to the problems described above, the method used to attach the flotation devices to the boat hull also creates a number of disadvantages. In Lowther, the flotation wings are attached by bolting through the foam wings and boat hull. This creates a number of holes in the hull and thus a significant risk of water leakage. If a boat incorporating the teachings of Lowther were operated at high speeds, the significant water pressures would likely force the foam flotation devices away from the hull, possibly resulting in loss of control of the boat or damage to the hull and the foam flotation devices. The water pressure would also likely force water through the holes by means of which the foam flotation devices are attached to the hull.

Other prior art boat designs use inflatable cylinders to form the sides of the boat, as in the case of Zodiac boats. The inflatable cylinders provide a high degree of stability to the boat but result in a loss of performance. Generally, prior art inflatable boat designs use inflatable cylinders as the sides of the boat and either a flexible floorboard or a rigid floorboard formed of wood or fiberglass. In operation, the cylinders serve as the running surface for the boat and remain in contact with the surface of the water; thus, a substantial wetted surface area and a significant amount of drag are created. This design also results in a very poor ride due to the fact that the boat tends to skip or bounce over the top of the waves. In addition, the inflatable cylinders are easily damaged and must constantly be inspected for tears, leaks, etc. Another disadvantage to inflatable boats is that typically the interior of the boat is very small, thus leaving little room for carrying equipment or passengers.

SUMMARY OF THE INVENTION

The present invention provides a safe, stable, high performance boat while reducing the disadvantages of prior art designs. The present invention's use of a rigid, planing boat hull combined with exterior foam stabilizing members which extend substantially around the perimeter of the boat hull results in these advantages without the disadvantages of typical inflatable boat designs. Furthermore, the foam stabilizing members are substantially out of contact with the surface of the water when the boat is at cruising speed. This decreases the wetted surface area of the boat when compared to inflatable boat designs, thus increasing performance. The foam stabilizing members also act as a running surface when a sharp turn is performed at high speed.

The present invention allows foam stabilizing members to be mounted to the sides of the boat hull in such a way that water pressure at high speeds does not force the foam stabilizing members away from the boat hull, thus preventing damage to the boat hull or stabilizing members. Furthermore, the foam stabilizing members are mounted to the hull without holes being formed in the sides of the boat, thus ensuring that mounting the stabilizing members on the hull does not create a possibility of leaks into the interior of the boat.

An embodiment of a foam-stabilized watercraft includes a rigid, planing hull having a transom and a pair of curved sides extending forwardly from the transom to form the bow of the watercraft. The sides and bottom of the hull are joined to form a chine. Foam stabilizing means for stabilizing the watercraft are mounted on the sides of the hull above the chine and extend from the transom along the length of the hull to the bow. The stabilizing means extends outwardly from the sides of the hull so that they contact and displace an increasing volume of water as the boat lists. This stabilizes the boat by increasing the righting moment of the hull.

According to other aspects of the invention, the watercraft includes a flange that extends outwardly from the sides of the hull. The flange is adapted to mate with the lower edge of the stabilizing means to ensure that water does not flow between the stabilizing means and the sides of the hull. Additionally, the stabilizing means has a surface adapted to be mounted to the sides of the watercraft and a curved surface extending outwardly from the sides of the hull.

BRIEF DESCRIPTION OF THE DRAWINGS

The foregoing aspects and many of the attendant advantages of this invention will be more readily appreciated as the same become better understood by reference to the following detailed description, taken in conjunction with the accompanying drawings, wherein.

DETAILED DESCRIPTION OF THE PREFERRED EMBODIMENT

Figure 1:
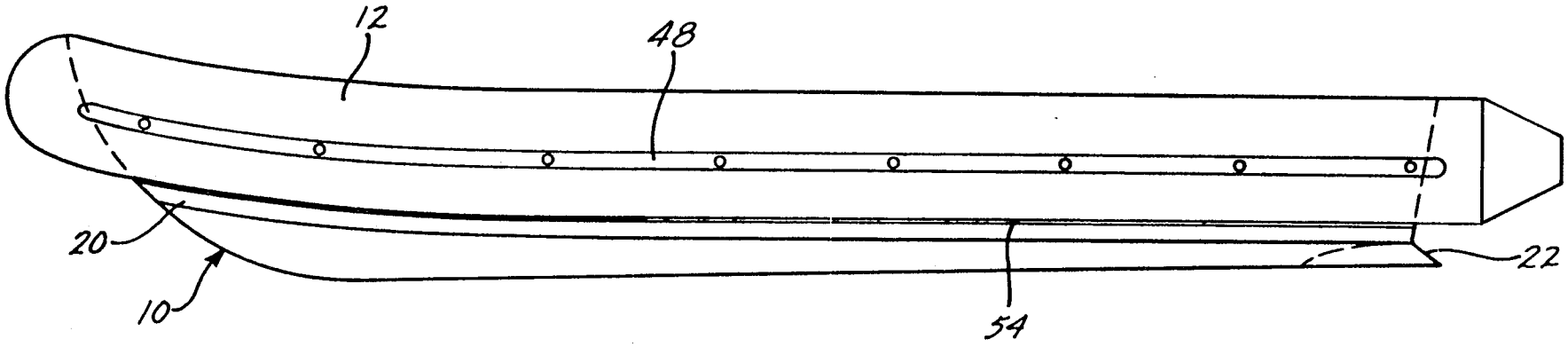
FIG. 1 is a side elevational view of one preferred embodiment of a foam stabilized watercraft made according to the present invention.
Figure 2:
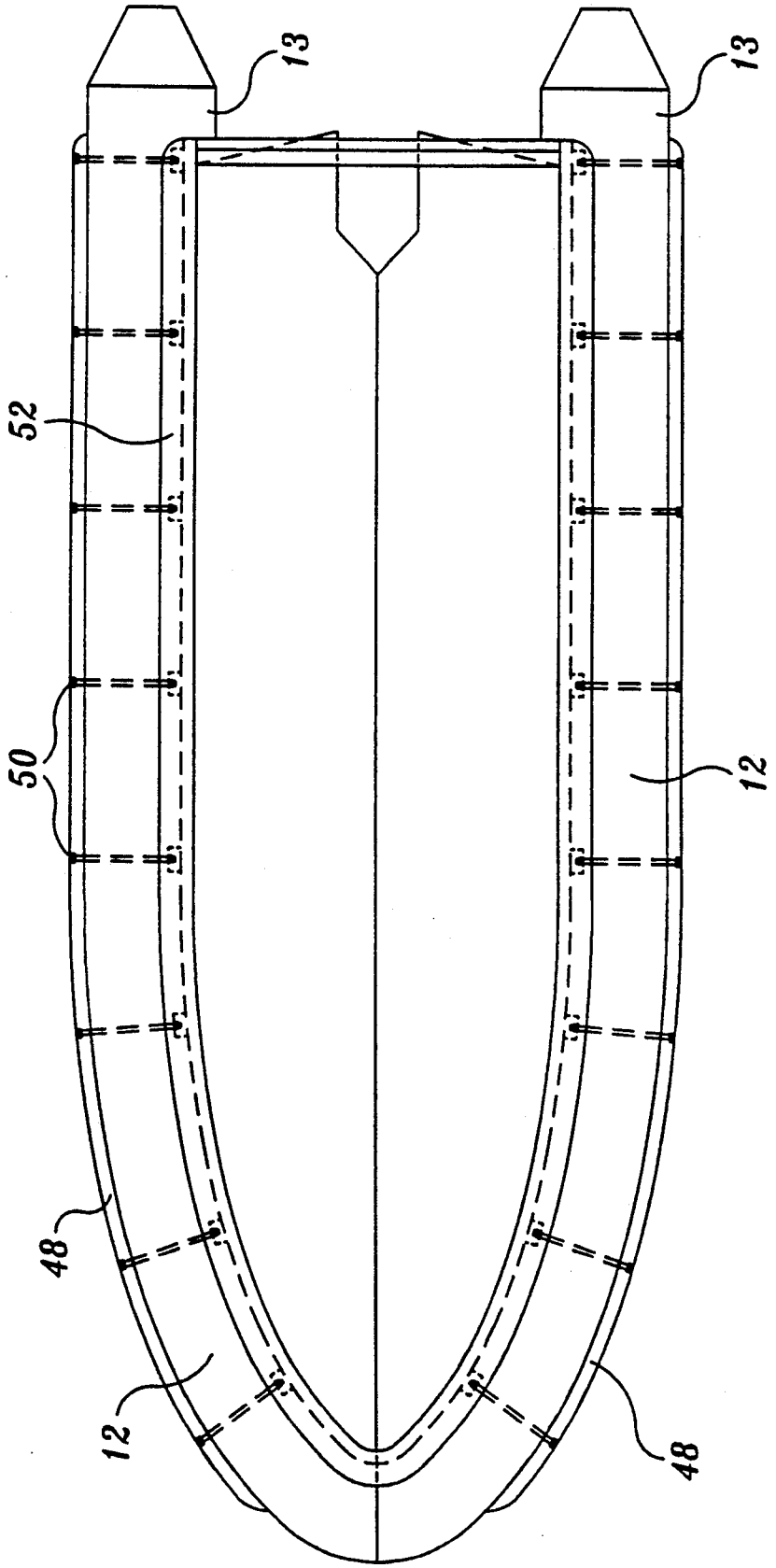
FIG. 2 is a top plan down view of the watercraft of FIG. 1.
Figure 3:
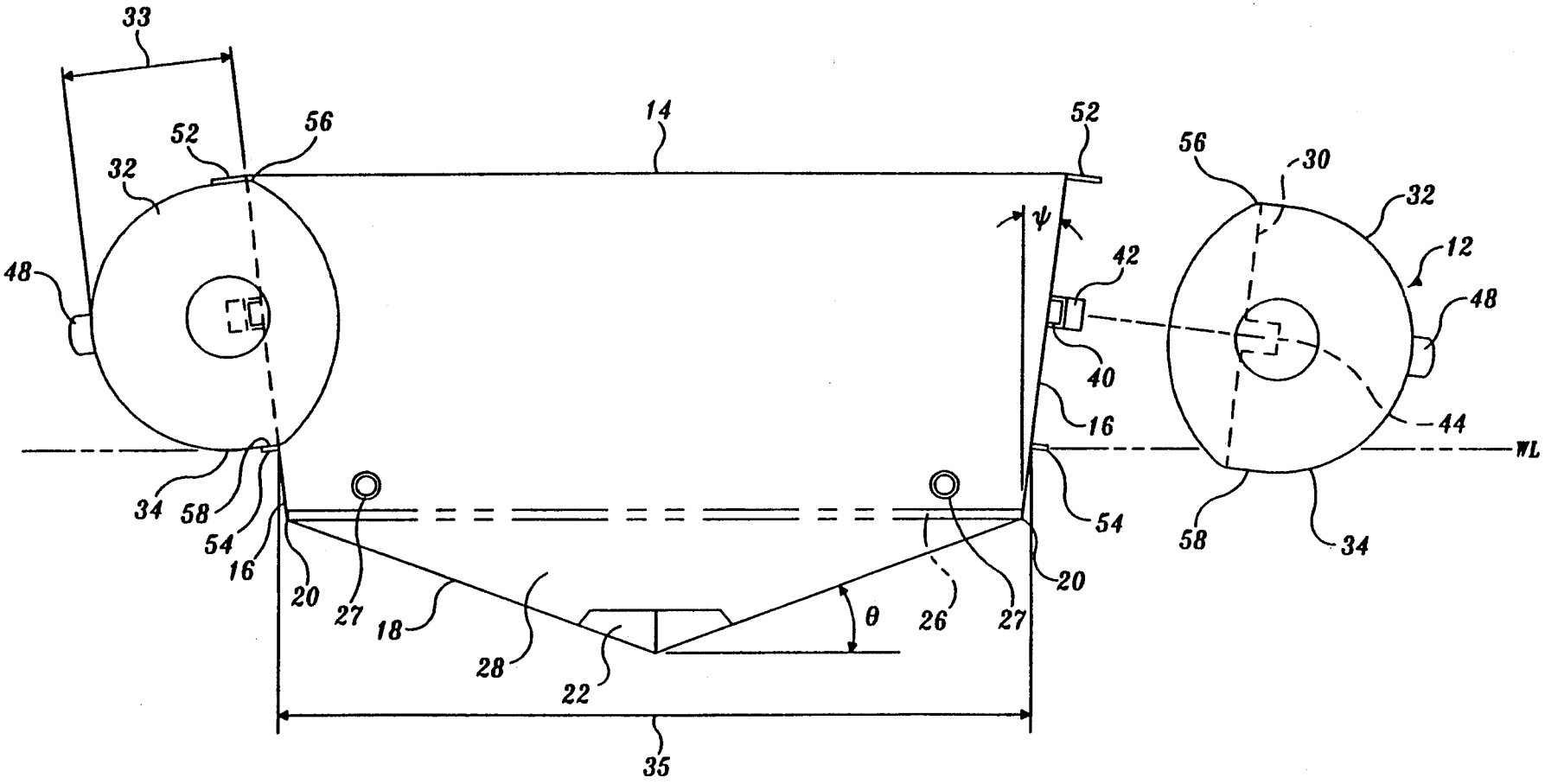
FIG. 3 is a rear view of the watercraft of FIG. 1.

Referring initially to FIGS. 1 and 2, a preferred embodiment of a foam stabilized watercraft of the present invention is disclosed. In the preferred embodiment, the watercraft includes a rigid hull 10 and two oppositely curved stabilizing members 12 located on the sides of the hull. The rigid hull may be formed of aluminum, fiberglass, Kevlar TM, or any other suitable material that can withstand the harsh and corrosive environment encountered by boat hulls. In the embodiment shown, the hull is designed to be a high-performance boat hull. The hull includes a transom 14 (FIGS. 3 and 4) which defines the stern of the boat, two sides 16 extending forward from the stern and curving toward each other to define the bow of the boat hull, and a bottom 18.

In the preferred embodiment shown, the bottom 18 defines a V that has a dead rise angle $\theta$ of approximately 16°. The dead rise angle is the angle at which the bottom of the hull rises with respect to the horizontal. The dead rise angle $\theta$ is determined to achieve the optimum performance for the intended hull application. Therefore, the dead rise angle $\theta$ will change depending upon the dimensions of the boat, the running speeds for which the boat is designed, and the application for which the boat was intended. A typical range of dead rise angles that could be expected in boat designs suitable for use with the present invention is from 10° to 20°, but lesser or greater angles could also be used.

In order to increase hull performance, two bottom extensions 22 and a tunnel 24 may be included on the bottom of the hull. The bottom extensions 22 are flush with the transom at the point where the sides 16 meet the transom and then extend rearwardly away from the transom as they extend toward the center of the bottom of the boat. The tunnel 24 is located in the center of the bottom of the boat and extends from the point where the bottom meets the transom forwardly toward the bow of the boat. The use of the bottom extensions 22 and the tunnel 24 helps to direct and increase water flow to an outboard motor (not shown) mounted on the transom. This allows the outboard motor to be mounted higher on the transom, thus allowing the boat hull to operate safely with a shallower draft than a similar hull without a tunnel.

In the preferred embodiment shown, the tunnel 22 has a height of approximately 5 inches and extends approximately 12 to 20 inches from the transom toward the bow of the boat. The height of the tunnel, width of the tunnel, length of the tunnel and the extent to which the bottom extensions extend past the transom will change depending upon the dimensions of the hull, the desired performance of the hull, and the application for which the hull is used. In general, the tunnel must be sized such that it allows a sufficient flow of the water to the outboard motor while not extending so far forward that air can flow through the tunnel when the bow of the boat lifts out of the water during high speed operation.

The sides 16 are joined to the bottom 18 of the boat and to the sides of the transom 14 such that a hard chine 20 is formed at the intersection between the sides and the bottom of the boat. A hard chine is formed when two discrete surfaces meet at an angle as opposed to a soft chine where the chine is part of a gradually curving surface, such as the surface of a number of sailboat hulls.

The sides 16 extend from the transom 14 forward toward the bow of the boat such that they curve and are joined to form the bow of the boat. The angle $\Psi$ (FIG. 3) at which the sides extend outwardly from the vertical is defined by the angle of the side edges of the transom and in the preferred embodiment shown is approximately 15°. The value of the angle $\Psi$ could change depending upon the size of the boat, the desired performance of the boat, and the application for which the boat is used. A typical range of values which could be expected for the angle $\Psi$ is from 10° to 20°. The curvature of the bow of the boat is also determined by the size of the boat, the desired performance of the boat, and the application for which the boat is intended.

In the preferred embodiment shown, the sides 16 are formed and joined to the bottom 18 such that the bow of the hull is deeper than the stern. This type of design helps to prevent the bow of the boat from digging into oncoming waves and also helps to prevent water from coming over the bow of the boat into the boat's interior.

As the hull moves through the water at higher speeds, the hull design of the preferred embodiment shown allows the bow of the hull to lift out of the water, thus allowing the boat to run substantially on the V-shaped bottom 18 of the boat. This decreases the wetted surface area of the hull thus increasing the speed that the boat is capable of achieving. This type of hull design is commonly referred to as a "planing hull."

In the preferred embodiment shown, it could be advantageous to place a floorboard 26 (FIG. 3) in the bottom of the boat. The floorboard 26 extends across the bottom of the boat at approximately the level of the chines 20 in order to define a flat surface. The flat surface created by the floorboard 26 makes it easier to move around the inside of the boat. Generally, boat floorboards are formed of a material highly resistant to water damage such as a vinyl-coated wood or a plastic material. Optionally, flotation materials, such as a closed cell foam, could be used to fill the volume 28 between the bottom of the boat and the floorboard. This would further increase the buoyancy of the hull, thus helping to ensure that the boat will float if capsized. It could also be advantageous to locate one-way drain valves, such as conventional scuppers 27 in the transom slightly above the floorboard line to allow any water inside the boat hull to self-drain out of the hull.

In order to increase safety, while gaining unique performance advantages, a pair of stabilizing member 12 are mounted to the sides of the hull above the chine 20.

Mounting the stabilization members above the chine as opposed to at or below the chine creates a number of advantages as explained below. Each stabilizing member 12 extends from a point rearward of the transom forward along the sides of the hull to the bow of the boat, as is best shown in FIGS. 1 and 2. The stabilizing members include rear extensions 13 which extend rearwardly beyond the transom in order to create platforms which reduce lifting of the bow during acceleration of the boat. The rear extensions 13 also provide additional lift in head and following seas, thus increasing the stability of the boat. In the preferred embodiment shown, the stabilizing members extend approximately 20 inches rearwardly beyond the transom. Although it could be advantageous to extend the stabilizing members beyond the transom, it will be understood that it is not a required aspect of the present invention to do so. In order to achieve additional strength and rigidity in the rearwardly extending stabilizing members, the members are formed to wrap around the hull at the transom.

In the preferred embodiment disclosed, the stabilizing members have a flat inner surface 30 for mounting adjacent to the side of the hull and a curved surface 32 extending outwardly from the sides of the hull. In the preferred embodiment shown, the stabilizing members are approximately 16 inches high and extend outwardly from the sides of the hull to a maximum width 33 (FIG. 3) of approximately 12 inches, however, these dimensions may change for different hull dimensions. It is believed that an optimum ratio of the maximum width 33 of each stabilizing member to the maximum beam 35 of the hull as defined at the water line (WL) when the boat is at a design weight is from approximately 1:3.5 to 1:4.5. It is also believed that an optimum ratio of the maximum width of the stabilizing member to the maximum height of the stabilizing member is from approximately 1.0:1.3 to 1.0:2.0

The stabilizing member 12 shown in the preferred embodiment employs a substantially round surface 32 because it presents a "non-trip chine" to the water and it reduces the possibility of damage to the surface of the stabilizing member as compared to a stabilizing member with relatively sharp corners.

It is not a requirement of the present invention that the stabilizing members have a substantially round surface, only that the lower surface 34 of the stabilizing members act as a "non-trip chine". A "non-trip chine" is an exterior surface of the stabilizing member which is curved such that it does not have any sharp corners which on contact with the surface of the water could "trip" the boat, i.e. result in a force which tends to force the boat out of its intended path or which could cause the boat to list badly to one side and possibly capsize.

Figure 5:
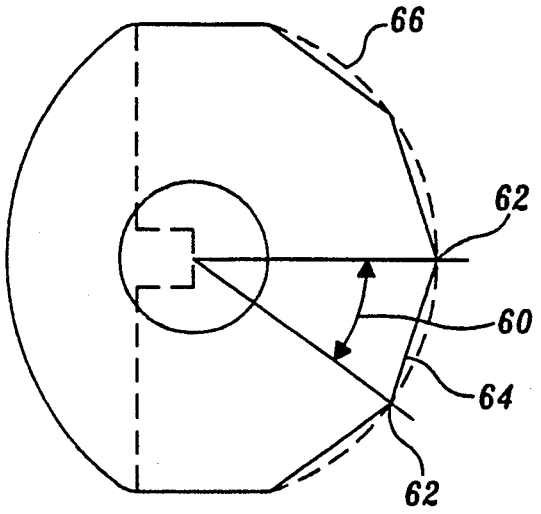
FIG. 5 is a rear view of a second embodiment of the stabilizing member of FIG. 1.

In the preferred embodiment, a "non-trip chine" means that the lower surface 34 of the stabilizing member must be curved. This does not mean that the lower surface must be continuously curved but only that no sharp corners are formed. It is believed that the lower surface maybe formed of a series of concatenated surfaces as long as the secant angle of each surface is no greater than 45°. As shown in a second embodiment of the stabilizing member (FIG. 5), the secant angle 60 is the angle defined by the two points 62 where one of the surfaces 64 contacts the arc 66 defined by the concatenated surfaces. Therefore, the lower surface 34 of the stabilizing members could be a portion of an octagon or have numerous other shapes.

In the preferred embodiment shown, the stabilizing members have a constant cross sectional area from the transom along the length of the boat. However, it is contemplated that the cross sectional area along the length of the stabilizing members could vary, as an example, the stabilizing members cross section could taper forwardly along its length.

The stabilizing members can be formed of any suitable buoyant foam which can withstand the harsh environment encountered by a high speed watercraft including normal docking and moorage bumping. It is also advantageous that the stabilizing members be formed from a foam that does not absorb water and has some memory. In the preferred embodiment shown, a closed cell polypropylene or polyethylene foam having a density of 1.7 $lb/ft^3$ is used to form the stabilizing members. It is believed that an optimum range of densities is from approximately 1 to 3 $lb/ft^3$.

The foam described above has some degree of memory, thus helping to reduce dents or dings in the foam and it is also relatively impervious to chemicals. In order to increase damage tolerance, it may also be beneficial to coat or cover the exterior of the stabilizing members with a protective material, such as a rubber, liquid vinyl or some other plastic material.

The present invention's use of stabilizing members formed from a buoyant closed cell foam has significant advantages over an inflatable boat. Unlike an inflatable boat, the stabilizing members of the present invention do not deflate due to seam failure, punctures, or air leaks. Additionally, it is not necessary to have a pump available or take the time to pump up the stabilizing members prior to each use of the boat.

The stabilizing members 12 are bolted to the sides of the hull, but not through the hull, using of a pair of longitudinally extending channel members 40. In the preferred embodiment, each channel member 40 is a 2 inch deep, U-shaped channel which is welded to the side of the boat such that it extends along each side of the boat substantially from the transom to the bow. An additional reinforcing member 42 is attached to the channel member 40 at each of the locations where the stabilizing member is to be bolted to the side of the boat. Each reinforcing member is formed from a piece of 4 inch long, U-shaped channel that is welded to the outer surface of the channel member 40 (see FIGS. 3 and 4). In alternate embodiments (not shown) the channel members and reinforcing members could be formed of solid bar stock or other shapes and be either welded or bonded to the side of the boat. A hole is drilled in the center of each reinforcing member 42 and either tapped or a retaining nut is attached to the inside surface of the channel at the hole in order to receive a threaded bolt 50.

Figure 4:
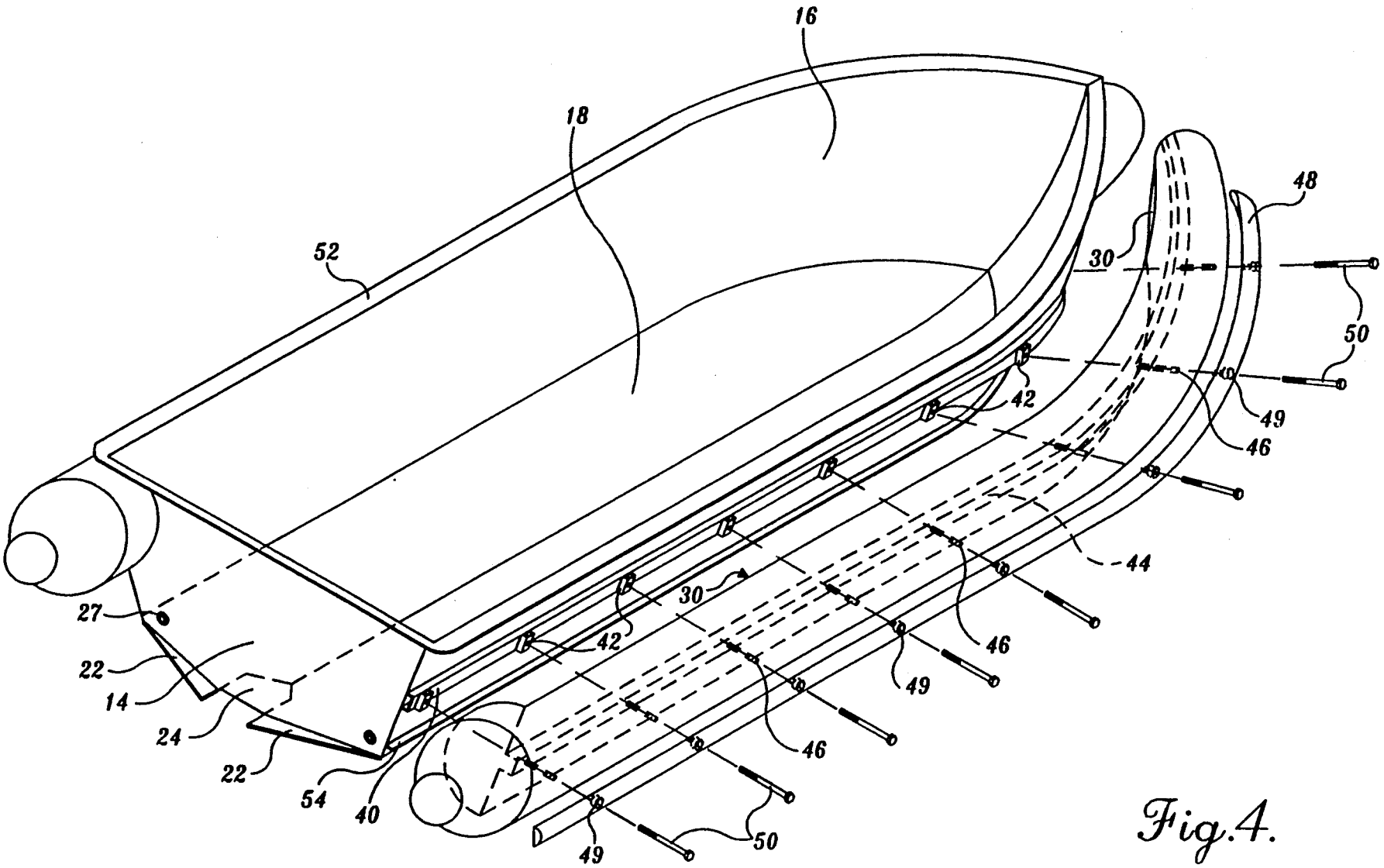
FIG. 4 is a partial exploded perspective view of the watercraft showing a method of attachment of the foam stabilization members to the side of the hull.

Each stabilizing member has a channel 44, shown in phantom in FIG. 4, located on the flat surface 30 of the stabilizing member. The channel 44 extends from the location where the stabilizing member attaches to the transom substantially to the bow of the boat. The channel 44 is sized to receive the channel member 40 and reinforcing members 42, thus allowing the flat surface 30 of the stabilizing members to be placed tightly against the sides of the boat. A series of drilled holes 46 extend through the stabilizing member into channel 44 so as to be aligned with the holes drilled in the reinforcing members 42. A retaining "rub" rail 48 having a plurality of holes or openings 49 therein is placed over the surface of the stabilizing member such that holes 49 are aligned with holes 46 in the stabilizing members and a series of threaded bolts 50 are extended through the rub rail and the stabilizing member to engage the tapped hole or nut in the reinforcing members 42.

In the preferred embodiment shown, the rub rail is formed of a solid rigid vinyl material; however, any material capable of preventing the bolts from pulling through the rub rail and into the stabilizing member is acceptable. It is advantageous to form bolts 50 from stainless steel so that they will withstand the corrosive environment in which the boat is designed to operate. In the preferred embodiment, the bolts are spaced approximately 22 inches apart along the length of channel 40, however, the bolt spacing is dependent on the size of the boat, the size of the stabilizing members, the material used to form the stabilizing members, the performance for which the boat is designed and other known factors.

In alternate embodiments, the stabilizing members could be attached to the sides of the hull through the use of an adhesive or the method used to bolt the stabilizing members to the side of the hull could differ slightly from the method shown in the preferred embodiment. As an example, one alternate embodiment (not shown) is to replace the solid rub rail 48 with a soft rubber rail and place solid rails in the foam stabilizing member. These solid rails within the foam could be individual members or a continuous U-shaped channel embedded within the foam at the locations 46 where the bolts 50 extend through the stabilizing members. The channels could be bonded in place and the bolts would bear against the channels, thus holding the stabilizing member against the hull. This alternate embodiment would allow the bolts to be shortened by the distance the channels were embedded in the foam, possibly reducing cost. Additionally, this would allow a soft rubber rub rail to be used on the exterior surface of the stabilizing members, thus ensuring that the rub rail does not mark another boat as it contacts the side of the other boat.

The use of the channel members 40, rub rails 48 and bolts 50 allow the stabilizing members to be mounted to the sides of the hull without the creation of any holes extending through the hull. This eliminates a significant disadvantage of prior boat designs in which water flows through the holes in the sides of the hull driven by the significant hydrostatic pressures created when a boat is driven through the water.

In addition to the channel members, the foam is secured to the hull through the use of an upper flange 52 and a lower flange 54. The upper flange 52 extends outward from the top edge of the sides of the hull and runs around the perimeter of the hull. The upper edge 56 (FIG. 3) of the stabilizing member 12 mates with both the upper flange and the side of the boat, thus helping to ensure that the stabilizing members will not move up and away from the boat during high speed operation of the boat. It is advantageous to use an upper flange 52 because of the significant upwardly directed forces placed on the stabilizing members while the boat is moving over the water at high speed. The upper flange also serves to protect the upper edge 56 of the stabilizing member, thus helping to prevent damage to the stabilizing member. In the disclosed embodiment flange 52 will be approximately 4 inches in width, it being understood that this may be varied so long as the above-described functions are still accomplished. Flange 52 is also useful for mounting fishing gear such as downriggers, fenders, oar locks, or the like.

The lower flange 54 extends outward from the sides of the hull such that it lies adjacent to the lower edge 58 of the stabilizing member. Lower flange 54 helps to prevent water from entering the interface between the surface 30 of the stabilizing member and the side of the boat. The use of a lower flange 54 is extremely important if foam stabilizing members are to be used on high performance boats. Without a lower flange or similar protective structure, the extremely high water pressures present during high speed boat operation can easily force the foam stabilizing members away from the boat hull, thus damaging the stabilizing members, hull, and possibly even tearing the stabilizing members completely away from the boat. In the preferred embodiment flange 54 is approximately 2 inches in width, but this dimension can be varied so long as the above-described functions are accomplished. Flanges 52 and 54 may be welded to the sides of the boat or integrally molded if the hull is molded.

In addition to the use of the channel members, bolts, and upper and lower flanges, the stabilizing members may be held to the sides of the hull by adjustment of the angle $\Psi$ at which the sides of the hull are canted from the vertical. As angle $\Psi$ increases, the stabilizing members are canted downwardly toward the surface of the water. This causes at least a portion of the forces placed on the stabilizing members during operation of the boat to direct the stabilizing members against the sides of the hull and the upper flange. Although canting the sides of the hull is not critical to achieve the benefits of the present invention, it is beneficial in the overall design.

Placing stabilizing members according to the present invention on the exterior surfaces of the hull produces a high performance, stable, safe boat. As the boat of the present invention begins to list, while at rest or moving, the lower surface of a stabilizing member is forced into the water. As the list increases, the stabilizing member displaces a larger and larger volume of water. This results in the stabilizing members producing a greater righting moment as the list increases, thus increasing stability. The righting moment is the tendency of a boat to return to an upright position upon listing. Furthermore, the stabilizing members of the present invention provide the boat with sufficient buoyancy to ensure that the boat will float even if filled with water or capsized.

Placing the stabilizing members above the chine of the hull also creates performance advantages over prior art designs. The use of a rigid planing hull in the present invention allows the stabilizing members to be lifted substantially out of contact with the surface of the water during high speed operation. This greatly reduces the wetted surface area and therefore the drag of the boat as compared to prior art inflatable boat designs. Furthermore, the curved lower surface of the stabilizing members serves as a safe running surface during sharp high speed turns. As a sharp turn is performed and the boat begins to list, the lower surface of a stabilizing member contacts the surface of the water and acts a "non-trip chine." This results in a boat of the present invention being capable of high speed operation without significant danger of "tripping" or capsizing the boat. Additionally, the rear extensions and buoyancy of the stabilizing members help lift the hull onto its planing surface this reducing the power requirement to began planing.

The unique combination of foam stabilizing members, V-shaped hull bottom, and high-performance transom tunnel provides a high speed, low draft boat which can be operated in shallow water or as an extremely safe, stable, high performance boat for open water running and rescue work. All of these advantages are achieved without the disadvantages and poor ride present in prior art inflatable boat designs.

As an illustrative but not limiting example, the preferred embodiment shown in FIGS. 1-5 could be constructed with an overall length of the boat from the rear of the stabilizing member extensions to the bow of the stabilizing members of approximately 15 feet, 11 inches and a maximum beam at the water line at design weight of 3 feet, 9 inches. The high performance hull illustrated in the preferred embodiment is capable of reaching speeds of approximately 45 miles per hour with a 50 horsepower outboard motor. Additionally, the interior volume of the hull is approximately three times the volume of a comparatively sized inflatable boat.

While the preferred embodiment of the invention has been illustrated and described, it will be appreciated that various changes can be made therein without departing from the spirit and scope of the invention. As an example, the shape of the hull including the transom, bow, and bottom can change without departing from the spirit and scope of the invention. It could also be possible to fabricate the stabilizing members or boat hull from materials not described in the present application.

The embodiments of the invention in which an exclusive property or privilege is claimed are defined as follows:

1. A high-performance foam stabilized watercraft for use on a body of water, the watercraft comprising:

(a) a rigid planing hull having a transom, a bottom, and a pair of curved sides extending forwardly from the transom to form the bow of the hull;

(b) foam stabilizing means for stabilizing the watercraft, mounted on the sides of the hull and extending from the transom at least substantially to the bow, the stabilizing means comprising at least one non-rigid, foam member extending outwardly from said sides, said foam member including a mating surface adapted to be mounted to said sides of the hull and a curved surface extending outwardly and upwardly from said sides of the hull so as to establish a lower surface of the stabilizing means, such that the the lower surface of the stabilizing means are adapted to contact the surface of the water and displace an increasing volume of water in response to an increasing list of the watercraft, thereby stabilizing the watercraft by increasing its righting moment; and (c) mounting means for holding the foam stabilizing means to the sides of the hull without forming holes in the hull.

2. The watercraft of claim 1, wherein the mounting means includes a lower flange extending outwardly from each side of the hull substantially over the length of the hull, the lower flange being adapted to mate with a lower edge of the stabilizing means, thereby preventing water from being forced between the stabilizing means and the sides of the hull.

3. The watercraft of claim 1, wherein the mounting means includes channel means attached to the sides of the hull above the lower flange and extending substantially along the length of the hull, the channel means being adapted to receive and hold a plurality of fasteners extending through the stabilizing means, thereby holding the stabilizing means against the sides of the hull.

4. The watercraft of claim 1, wherein the mounting means further includes an upper flange extending outwardly from each side of the hull substantially over the length of the hull, the upper flange being adapted to overlie an upper edge of the stabilizing means.

5. The watercraft of claim 1, wherein the curved surface comprises a series of concatenated surfaces forming essentially an arc, and wherein the secant angle of each concatenated surface is equal to or less than 45°.

6. The watercraft of claim 1, wherein the stabilizing means is formed of a closed cell polypropylene or polyethylene foam.

7. The watercraft of claim 1, wherein the ratio of the maximum distance that each member extends outwardly from the sides of the hull to the maximum beam of the hull at the water line is from approximately 1.0:3.5 to 1.0:4.5.

8. A foam stabilized watercraft for operation on a body of water, the watercraft comprising:

(a) a rigid planing hull having a transom, a bottom and a pair of curved sides extending forwardly from the transom to form the bow of the hull, the sides and bottom being joined along their length to form a chine;

(b) foam stabilizing means for stabilizing the watercraft, comprising at least one non-rigid foam member mounted on said sides of the hull above the chine and extending from the transom to the bow, said foam member having a first surface adapted to be mounted adjacent to said sides of the hull and a curved surface extending outwardly and upwardly from said sides of the hull so as to establish a lower surface of the stabilizing means, such that the stabilizing means is substantially out of contact with the surface of the water when the watercraft is at planing speed and traveling in a straight line, and wherein the the lower surface of the stabilizing means contacts the surface of the water and displaces an increasing volume of water as the watercraft lists to a greater degree, thereby stabilizing the watercraft by increasing its righting moment; and (c) mounting means for holding the stabilizing means to the sides of the hull.

9. The watercraft of claim 8, wherein the mounting means includes a lower flange extending outwardly from each side of the hull substantially over the length of the hull, the lower flange being adapted to mate with the lower edge of the stabilizing means, thereby preventing water from being forced between the stabilizing means and the sides of the hull.

10. The watercraft of claim 8, wherein the mounting means includes at least one channel member attached to the exterior sides of the hull above the lower flange, the channel member extending substantially over the length of the hull and being adapted to receive and hold a plurality of fasteners extending through the stabilizing means, thereby holding the stabilizing means against the sides of the boat.

11. The watercraft of claim 8, wherein the mounting means further includes an upper flange extending outwardly from each side of the hull substantially over the length of the hull, the upper flange being adapted to overlie the upper edge of the stabilizing means.

12. The watercraft of claim 8, wherein the curved surface comprises a series of concatenated surfaces forming essentially an arc, and wherein the secant angle of each concatenated surface is equal to or less than 45°.

13. The watercraft of claim 8, wherein the stabilizing means is formed of a closed cell polypropylene or polyethylene foam.

14. The watercraft of claim 8, wherein the ratio of the maximum distance that each member extends outwardly from the sides of the hull to the maximum distance of the hull at the water line is approximately 1.0:3.5 to 1.0:4.5.

15. The watercraft of claim 8, wherein the stabilizing members extend rearwardly beyond the transom.

16. A high performance foam stabilized watercraft for use on a body of water, the watercraft comprising:

(a) a rigid planing hull having a transom, a bottom, and a pair of curved sides extending forwardly from the transom to form the bow of the hull;

(b) foam stabilizing means for stabilizing the watercraft, mounted on the sides of the hull and extending from the transom to the bow, the stabilizing means comprising at least one non-rigid damage tolerant foam member extending outwardly from said sides, said foam member and including a mating surface adapted to be mounted to said sides of the hull and a curved surface extending outwardly and upwardly from said sides of the hull so as to establish a lower surface of the stabilizing means, such that the lower surface of the stabilizing means are mounted to contact the surface of the water and displace an increasing volume of water in response to an increasing list of the watercraft, thereby stabilizing the watercraft by increasing its righting moment.

17. The watercraft of claim 16, wherein the mounting means includes a lower flange extending outwardly from each side of the hull substantially over the length of the hull, the lower flange being adapted to mate with a lower edge of the stabilizing means, thereby preventing water from being forced between the stabilizing means and the sides of the hull.

18. The watercraft of claim 16, wherein the mounting means includes channel means attached to the sides of the hull above the lower flange and extending substantially along the length of the hull, the channel means being adapted to receive and hold a plurality of fasteners extending through the stabilizing means, thereby holding the stabilizing means against the sides of the hull.

19. The watercraft of claim 16, wherein the mounting means further includes an upper flange extending outwardly from each side of the hull substantially over the length of the hull, the upper flange being adapted to overlie an upper edge of the stabilizing means.

20. The watercraft of claim 16, wherein the curved surface comprises a series of concatenated surfaces forming essentially an arc, and wherein the secant angle of each concatenated surface is equal to or less than 45°.

* * * * *

UNITED STATES PATENT AND TRADEMARK OFFICE

CERTIFICATE OF CORRECTION

PATENT NO. : 5,282,436
DATED : February 1, 1994
INVENTOR(S) : W. M. Hansen

It is certified that error appears in the above-indentified patent and that said Letters Patent is hereby corrected as shown below:

| COLUMN | LINE | |
|---|---|---|
| [56] "U.S. Patents" | 7th Ref. | Please add --D308,042 05/1990 W. M. Kitner et al.-- |
| [56] "U.S. Patents" | 8th Ref. | Please add --3,321,784 05/1967 E. W. Rasmussen-- |
| [56] "U.S. Patents" | 9th Ref. | Please add --3,648,641 03/1972 L. P. Normand, Jr.-- |
| [56] "U.S. Patents" | 10th Ref. | Please add --3,732,587 05/1973 H. A. Fletcher-- |
| [56] "U.S. Patents" | 11th Ref. | Please add --4,060,864 12/1977 R. G. Woolworth-- |
| [56] "U.S. Patents" | 12th Ref. | Please add --4,060,865 12/1977 R. G. Woolworth-- |
| [56] "U.S. Patents" | 13th Ref. | Please add --4,287,624 09/1981 L. Y. Lowther-- |
| [56] "U.S. Patents" | 14th Ref. | Please add --4,679,522 07/1987 H. Nishida-- |
| [56] "U.S. Patents" | 15th Ref. | Please add --4,694,770 09/1987 W. M. Kitner et al.-- |
| [56] "U.S. Patents" | 16th Ref. | Please add --5,036,789 08/1991 R. T. Kelly et al.-- |
| [56] "Foreign Patents" | 1st Ref. | Please add --2,113,156 08/1983 United Kingdom-- |

UNITED STATES PATENT AND TRADEMARK OFFICE

CERTIFICATE OF CORRECTION

PATENT NO. : 5,282,436

DATED : February 1, 1994

INVENTOR(S) : W. M. Hansen

It is certified that error appears in the above-indentified patent and that said Letters Patent is hereby corrected as shown below:

| COLUMN | LINE | |
|---|---|---|
| [56] "Foreign | 2nd Ref. Patents" | Please add --2,208,628 04/1989 United Kingdom-- |
| [56] "Foreign | 3rd Ref. Patents" | Please add --2474-991 02/1980 France-- |
| [56] "Foreign | 4th Ref. Patents" | Please add --2633-583 07/1988 France-- |
| [56] "Foreign | 5th Ref. Patents" | Please add --WO87/05273 09/1987 PCT-- |

UNITED STATES PATENT AND TRADEMARK OFFICE

CERTIFICATE OF CORRECTION

PATENT NO. : 5,282,436

DATED : February 1, 1994

INVENTOR(S) : W. M. Hansen

It is certified that error appears in the above-indentified patent and that said Letters Patent is hereby corrected as shown below:

| COLUMN | LINE | |
|---|---|---|
| 10 (Claim 8 | 41 Line 20) | delete "the" (second occurrence) |
| 11 (Claim 16 | 25 Line 11) | after "member" delete "and" |

Signed and Sealed this

Twenty-sixth Day of July, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,282,436 C1
APPLICATION NO. : 90/006382
DATED : June 13, 2006
INVENTOR(S) : W.M. Hansen It is certified that error appears in the above-identified patent and that said Letters Patent is hereby corrected as shown below:

| | | |
|---|---|---|
| Title Page<br>Item (56)<br>Pg. 1, col. 2 | Refs. Cited<br>(Foreign<br>Pats., Item 6) | "2 238 925" should read --2 238 025-- |

Signed and Sealed this

Twelfth Day of December, 2006

JON W. DUDAS
*Director of the United States Patent and Trademark Office*

US005282436C1

(12) EX PARTE REEXAMINATION CERTIFICATE (5398th)

United States Patent

Hansen

(10) Number: US 5,282,436 C1

(45) Certificate Issued: Jun. 13, 2006

(54) FOAM STABILIZED WATERCRAFT

(75) Inventor: William M. Hansen, Port Orchard, WA (US)

(73) Assignee: Norseman Marine Products, Inc., Port Orchard, WA (US)

Reexamination Request:
No. 90/006,382, Sep. 16, 2002

Reexamination Certificate for:

| | |
|---|---|
| Patent No.: | **5,282,436** |
| Issued: | **Feb. 1, 1994** |
| Appl. No.: | **07/821,979** |
| Filed: | **Jan. 15, 1992** |

Certificate of Correction issued Jul. 26, 1994.

(51) Int. Cl.
*B63B 1/20* (2006.01)

(52) U.S. Cl. ..... 114/283; 114/357; D12/300

(58) Field of Classification Search ..... None
See application file for complete search history.

(56) References Cited

U.S. PATENT DOCUMENTS

| | | | |
|---|---|---|---|
| 3,065,724 | A | 11/1962 | Tritt |
| 3,261,038 | A | 7/1966 | Klepper |
| 4,060,864 | A | 12/1977 | Woolworth |
| 4,060,865 | A | 12/1977 | Woolworth |
| 5,228,407 | A | 7/1993 | Cummer et al. |

FOREIGN PATENT DOCUMENTS

| | | | |
|---|---|---|---|
| EP | 0 429 107 | B1 | 4/1994 |
| FR | 84 07784 | | 11/1985 |
| GB | 2 161 118 | A | 1/1986 |
| GB | 2 184 984 | A | 7/1987 |
| GB | 2 196 717 | A | 5/1988 |
| GB | 2 238 925 | A | 5/1991 |
| JP | 61-54383 | | 3/1986 |
| SU | 1369-985 | A | 1/1988 |

OTHER PUBLICATIONS

*Safety at Sea*, pp. 12–15, Mar. 1985.
*Safety at Sea*, pp. 13, 18 and 40, Jun. 1985.
*Safety at Sea*, pp, 26–27, Apr. 1987.
*Safety at Sea*, pp. 21, 22 and 24, Jul. 1988.
*Safety at Sea*, pp. 10–11, Oct. 1988.
*Safety at Sea*, pp. 17 and 19, Apr. 1990.

*Primary Examiner*—Jesus D. Sotelo

(57) ABSTRACT

A high performance boat stabilized through the use of foam stabilizing members is provided. The boat has a rigid, planing hull including a transom, and a pair of curved sides extending forward from the transom to form a bow. A bottom is joined to the sides forming a chine. The foam stabilizing members are mounted on the sides of the hull above the chine and extend from the transom along the length of the boat. The sides of the boat also include an upper and lower flange extending outwardly from the sides of the boat adjacent to the upper and lower edges of the stabilizing members at the location where the stabilizing members attach to the sides of the hull. The lower flange helps to ensure that water is not forced in between the sides of the boat and the stabilizing members, thus preventing possible damage to the boat. Additionally, the stabilizing members are attached to the side of the hull without the use of holes extending from the exterior to the interior of the hull, thus preventing water from seeping into the hull.

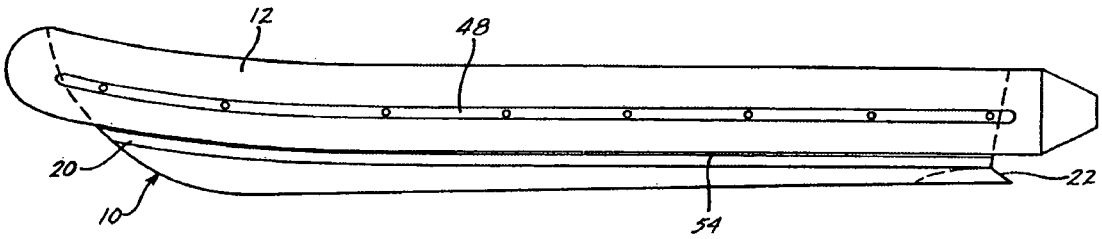

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3, 4, 8, 10, 11, 16, 18 and 19 are determined to be patentable as amended.

Claims 2, 5–7, 9, 12–15, 17 and 20, dependent on an amended claim, are determined to be patentable.

1. A high-performance foam stabilized watercraft for use on a body of water, the watercraft comprising:

(a) a rigid planing hull having a transom, a bottom, and a pair of curved sides extending forwardly from the transom to form the bow of the hull, *the curved sides defining an upper edge of the watercraft periphery*;

(b) foam stabilizing means for stabilizing the watercraft, mounted on the sides of the hull and extending from the transom at least substantially to the bow, the stabilizing means comprising at least one non-rigid, foam member extending outwardly from said sides, said foam member including a *substantially flat* mating surface adapted to be mounted to said sides of the hull and a curved surface extending outwardly and upwardly from said sides of the hull so as to establish a lower surface of the stabilizing means, such that the lower surface of the stabilizing means are adapted to contact the surface of the water and displace an increasing volume of water in response to an increasing list of the watercraft, thereby stabilizing the watercraft by increasing its righting moment, *and wherein the foam member is D-shaped in cross-section along most of its length*; and (c) mounting means for holding the foam stabilizing means to the sides of the hull without forming holes in the hull, *wherein the mounting means includes a protective structure that extends outward from the sides of the hull over the length of the hull below the foam member to prevent high pressure water from entering between the mating surface of the foam member and the sides of the hull during high speed boat operation*.

3. The watercraft of claim [1] *2*, wherein the mounting means includes channel means attached to the sides of the hull above the lower flange and extending substantially along the length of the hull, the channel means being adapted to receive and hold a plurality of fasteners extending through the stabilizing means, thereby holding the stabilizing means against the sides of the hull.

4. The watercraft of claim [1] *3*, wherein the mounting means further includes an upper flange extending outwardly from each side of the hull substantially over the length of the hull, the upper flange being adapted to overlie an upper edge of the stabilizing means.

8. A foam stabilized watercraft for operation on a body of water, the watercraft comprising:

(a) a rigid planing hull having a transom, a bottom and a pair of curved sides extending forwardly from the transom to form the bow of the hull, the sides and bottom being joined along their length to form a chine;

(b) foam stabilizing means for stabilizing the watercraft, comprising at least one non-rigid foam member mounted on said sides of the hull above the chine and extending from the transom to the bow, said foam member having a first surface adapted to be mounted adjacent to said sides of the hull and a curved surface extending outwardly and upwardly from said sides of the hull so as to establish a lower surface of the stabilizing means, such that the stabilizing means is substantially out of contact with the surface of the water when the watercraft is at planing speed and traveling in a straight line, and wherein the lower surface of the stabilizing means contacts the surface of the water and displaces an increasing volume of water as the watercraft lists to a greater degree, thereby stabilizing the watercraft by increasing its righting moment, *and wherein the foam member is D-shaped in cross-section along most of its length, and further wherein the foam member does not extend substantially above the sides of the rigid planing hull*; and (c) mounting means for holding the stabilizing means to the sides of the hull *without forming holes in the hull, wherein the mounting means includes a protective structure that extends outward from the sides of the hull over the length of the hull below the non-rigid foam member to prevent high pressure water from entering between the mating surface of the foam member and the sides of the hull during high speed boat operation*.

10. The watercraft of claim [8] *9*, wherein the mounting means includes at least one channel member attached to the exterior sides of the hull above the lower flange, the channel member extending substantially over the length of the hull and being adapted to receive and hold a plurality of fasteners extending through the stabilizing means, thereby holding the stabilizing means against the sides of the boat.

11. The watercraft of claim [8] *10*, wherein the mounting means further includes an upper flange extending outwardly from each side of the hull substantially over the length of the hull, the upper flange being adapted to overlie the upper edge of the stabilizing means.

16. A high performance foam stabilized watercraft for use on a body of water, the watercraft comprising:

(a) a rigid planing hull having a transom, a bottom, and a pair of curved sides extending forwardly from the transom to form the bow of the hull; *and*

(b) foam stabilizing means for stabilizing the watercraft, mounted on the sides of the hull and extending from the transom to the bow, the stabilizing means comprising at least one non-rigid damage tolerant foam member extending outwardly from said sides *and not extending substantially above said sides,* said foam member including a *substantially flat* mating surface adapted to be mounted to said sides of the hull and a curved surface extending outwardly and upwardly from said sides of the hull so as to establish a lower surface of the stabilizing means, such that the lower surface of the stabilizing means are mounted to contact the surface of the water and displace an increasing volume of water in response to an increasing list of the watercraft, thereby stabilizing the watercraft by increasing its righting moment, *and wherein the foam member is D-shaped in cross-section along most of its length; and*

(*c*) *mounting means for holding the stabilizing means to the sides of the hull without forming holes in the hull,*

*wherein the mounting means includes a protective structure that extends outward from the sides of the hull over the length of the hull below the non-rigid foam member to prevent high pressure water from entering between the mating surface of the foam member and the sides of the hull during high speed boat operation.*

18. The watercraft of claim [16] *17*, wherein the mounting means includes channel means attached to the sides of the hull above the lower flange and extending substantially along the length of the hull, the channel means being adapted to receive and hold a plurality of fasteners extending through the stabilizing means, thereby holding the stabilizing means against the sides of the hull.

19. The watercraft of claim [16] *18*, wherein the mounting means further includes an upper flange extending outwardly from each side of the hull substantially over the length of the hull, the upper flange being adapted to overlie an upper edge of the stabilizing means.

* * * * *